United States Patent [19]

Knecht

[11] 4,351,463

[45] Sep. 28, 1982

[54] DEVICE FOR FEEDING WEB-SHAPED PACKAGING MATERIAL

[75] Inventor: Siegfried H. Knecht, Gevelsberg, Fed. Rep. of Germany

[73] Assignee: Maschinenfabrik Alfred Schmermund GmbH & Co., Gevelsberg, Fed. Rep. of Germany

[21] Appl. No.: 222,286

[22] Filed: Jan. 5, 1981

[30] Foreign Application Priority Data

Jan. 22, 1980 [DE] Fed. Rep. of Germany ..... 3002092

[51] Int. Cl.[3] ..... B65H 17/22; B65H 75/02

[52] U.S. Cl. ..... 226/154; 226/190; 242/55; 242/56 R

[58] Field of Search ..... 226/190, 152, 154, 155; 242/58.1, 58.2, 58.3, 58.4, 67.1 R, 67.2, 67.3 R, 56 R

[56] References Cited

U.S. PATENT DOCUMENTS

| | | | |
|---|---|---|---|
| Re. 21,319 | 1/1940 | Tornberg | 242/58.1 X |
| 2,745,464 | 5/1956 | Auerbacher | 242/58.4 X |
| 3,115,999 | 12/1963 | Wythe | 226/154 X |
| 3,552,668 | 1/1971 | Kanno | 242/56 R |

*Primary Examiner*—Edward J. McCarthy

*Attorney, Agent, or Firm*—Williamson, Bains, Moore & Hansen

[57] ABSTRACT

Spool changing apparatus for alternately pulling web-shaped packaging material from two supply spools and feeding the material sequentially to a pair of engraving rollers, a pair of conveying rollers, and a cutting device along a conveying track. An auxiliary device is provided to separate the embossing rollers as a new supply of packaging material is fed therethrough. The material is thus initially conveyed without embossing, thereby avoiding coiling of the new length of packaging material at the outlet side of the embossing rollers.

5 Claims, 1 Drawing Figure

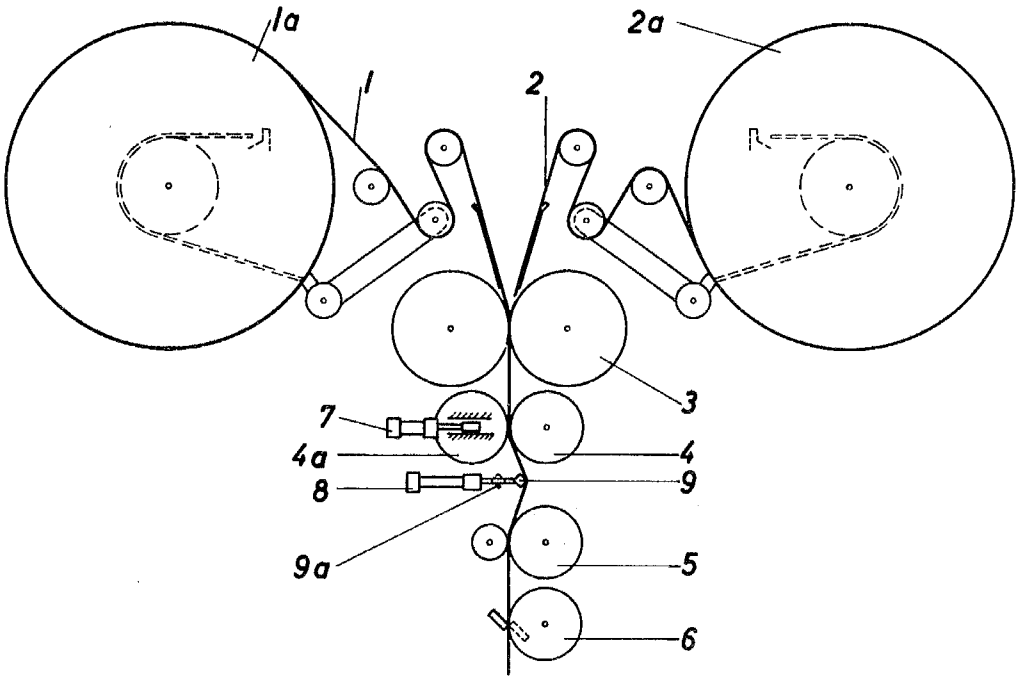
2a
2
1
1a
3
4
9
5
6
7
4a
8
9a

DEVICE FOR FEEDING WEB-SHAPED PACKAGING MATERIAL

BACKGROUND OF THE INVENTION

The invention relates to a device for feeding web-shaped packaging material to a packaging machine comprising a spool change device for pulling the packaging material alternately from two spools and for feeding the material to a common conveying track along which a pair of engraving rollers, a pair of conveying rollers, and a cutting device are disposed.

Such a device is used for example for feeding portions of foil for wrapping blocks of cigarettes on cigarette packaging machines.

In this case a problem arises in the embossing process in that the foil has a tendency to coil up after the embossing. So long as a foil web is pulled from a spool and is gripped by a pair of conveying rollers behind the embossing rollers with reference to the running direction, this is not important. However, on changing over from one spool to the other, when the beginning of the new spool runs through the embossing station, the coiling-up effect on the foil hinders further conveying.

Up to the present time this problem has been solved by joining the beginning of the new coil to the end of the old by means of adhesive strips or the like. Thus a device is known in which this problem is solved by disposing two embossing rollers in front of the spool change station of each spool, with respect to the running direction. Splicing, i.e., the joining of the new to the exhausted web is however costly and gives rise to interferences with the packaging process. Moreover, the incorporation of one pair of embossing rollers per spool is costly from the construction aspect, as not only a second pair of rollers but also a drive therefor are required.

BRIEF SUMMARY OF THE INVENTION

The object of the invention is therefore to provide a device of the aforesaid type which avoids having to carry out the splicing while the pair of engraving rollers is operating.

This object is attained in that an auxiliary drive is provided which varies the distance between the rotational axes of the embossing rollers at the time of arrival of the beginning of the packaging material from a new spool to such an extent that only conveying takes place without any embossing. Thus, no coiling up of the foil occurs. Such a device can be inserted into the conveying station following the embossing station without problem.

The invention is described in greater detail hereinafter with reference to the embodiment shown by way of example.

BRIEF DESCRIPTION OF THE DRAWING

The single FIGURE of the drawing shows the preferred embodiment of the invention in partially schematic plan view.

A foil web 1 is unwound from a spool 1*a* and runs through a spool change station 3 in which the beginning of a second foil web 2 from a spool 2*a* is in a waiting position.

The foil web 1 then runs through an embossing station between two engraving rollers 4 and 4*a*, and then over a deflection device 9, and is guided to a cutting roller 6 with the aid of a pair of conveying rollers 5. By this means the coiling-up effect on the foil is nullified so that a foil portion separated by means of the cutting roller 6 can then be fed to a packaging machine without problem. The purpose of the deflection device 9 is to nullify the coiling-up effect in the packaging material so that the individual separated sheets later become straight. This operation is in the manner of smoothing a sheet of paper by drawing it over an edge.

On changing over from spool 1*a* to spool 2*a*, the beginning of the foil web 2 must be conveyed through the embossing station and between the pair of conveying rollers 5. In order to make this possible, auxiliary drives 7 and 8, which are for example in the form of pneumatically operated piston-cylinder units connected to an engraving roller 4*a* and to the deflection device 9, respectively, are activated by the deflection device. The auxiliary drive 7 withdraws the engraving roller 4*a* from the engraving roller 4 to such an extent that the foil web 2 running therethrough comes only into light contact, i.e., conveying takes place without any embossing. At the same time, the deflection device 9 is swiveled or withdrawn from the conveying track into the position 9*a* by means of the auxiliary drive 8, so that the foil web 2 can be inserted between the conveying rollers 5 in a straight direction. As soon as the beginning of the foil web 2 is reliably gripped by the conveying rollers 5, the deflection device 9 is again moved into the conveying track, and the engraving roller 4*a* is again pressed against the engraving roller 4 by acuation of the auxiliary drives 8 and 7, respectively.

It is anticipated that various changes can be made in the size, shape, and arrangement of the elements of the apparatus disclosed herein without departing from the spirit and scope of the invention as defined by the following claims.

What is claimed is:

1. In a spool changing device for alternately feeding web-shaped packaging material from two supply spools to a packaging machine by way of a common conveying track along which a pair of engraving rollers, a pair of conveying rollers, and a cutting device are sequentially positioned, the improvement comprising:

auxiliary drive means mechanically associated with said engraving rollers and operable to vary the distance between the axes of said engraving rollers, whereby said engraving rollers may be moved apart by said auxiliary drive means to a position wherein conveying takes place without embossing when the leading end of packaging material arrives from a new spool.

2. A device as set forth in claim 1 wherein:

said auxiliary drive means comprises motor means drivingly connected to one of said engraving rollers for movement thereof towards and away from the other one of said engraving rollers.

3. A device as set forth in claim 2 wherein:

said motor means comprises a fluid driven, power cylinder.

4. A device as set forth in claim 1 wherein:

a packaging material deflection device is positioned after said engraving rollers in the running direction of the packaging material; and second drive means mechanically connected to said deflection device and operable to move said deflection device out of the conveying path of the packaging material.

5. A device as set forth in claim 3 wherein:

said second drive means comprises a fluid driven, power cylinder operable to move said deflection device into and out of the conveying path of the packaging material.

* * * * *